US009550374B1

(12) United States Patent
Marino et al.

(10) Patent No.: US 9,550,374 B1
(45) Date of Patent: Jan. 24, 2017

(54) SYSTEM AND METHOD FOR IMPROVED DIGITAL PRINTING ON TEXTILES

(75) Inventors: Robert Marino, Louisville, KY (US); Fred Edward Durham, III, Anchorage, KY (US); Christopher Allen Freeman, Louisville, KY (US); Daniel L. Dilamarter, Louisville, KY (US)

(73) Assignee: CafePress Inc., Louisville, KY (US)

( * ) Notice: Subject to any disclaimer, the term of this patent is extended or adjusted under 35 U.S.C. 154(b) by 1571 days.

(21) Appl. No.: 12/163,982

(22) Filed: Jun. 27, 2008

Related U.S. Application Data

(60) Provisional application No. 60/937,602, filed on Jun. 27, 2007.

(51) Int. Cl.
*B41J 3/407* (2006.01)
*D06P 5/30* (2006.01)

(52) U.S. Cl.
CPC ..... *B41J 3/4078* (2013.01); *D06P 5/30* (2013.01)

(58) Field of Classification Search
CPC ..... D06P 5/00; B41M 5/0041; B41M 5/0047; B41J 3/4078
See application file for complete search history.

(56) References Cited

U.S. PATENT DOCUMENTS

| | | | | |
|---|---|---|---|---|
| 3,968,498 | A | 7/1976 | Uchiyama | 346/29 |
| 4,021,591 | A | 5/1977 | De Vries et al. | 428/200 |
| 4,296,421 | A | 10/1981 | Hara et al. | 346/140 R |
| 4,312,007 | A | 1/1982 | Winfield | 346/140 R |
| 4,380,770 | A | 4/1983 | Maruyama | 346/140 R |
| 4,630,076 | A | 12/1986 | Yoshimura | 346/140 R |
| 4,702,742 | A | 10/1987 | Iwata et al. | 8/495 |
| 5,349,021 | A | 9/1994 | Rooney et al. | 524/761 |
| 5,501,902 | A | 3/1996 | Kronzer | 428/323 |
| 5,510,415 | A | 4/1996 | Zahrobsky et al. | 524/506 |
| 5,534,904 | A | 7/1996 | Sheinman | 347/75 |
| 5,582,104 | A | 12/1996 | Best et al. | 101/126 |
| 5,594,044 | A | 1/1997 | Yang | 523/160 |
| 5,631,684 | A | 5/1997 | Takaide et al. | 347/100 |
| 5,645,888 | A | 7/1997 | Titterington et al. | 427/256 |
| 5,757,407 | A | 5/1998 | Rezanka | 347/102 |
| 5,798,179 | A | 8/1998 | Kronzer | 428/411.1 |
| 5,885,335 | A | 3/1999 | Adams et al. | 106/316 |
| 5,902,387 | A | 5/1999 | Suzuki et al. | 106/22 R |
| 5,981,113 | A | 11/1999 | Christian | 430/9 |
| 5,988,791 | A | 11/1999 | Miyashita et al. | 347/43 |
| 6,042,228 | A | 3/2000 | Yamada et al. | 347/104 |
| 6,059,391 | A | 5/2000 | Fulkerson et al. | 347/2 |
| 6,087,061 | A | 7/2000 | Hare et al. | 430/256 |
| 6,095,628 | A | 8/2000 | Rhome | 347/4 |
| 6,117,921 | A | 9/2000 | Ma et al. | 523/161 |
| 6,126,281 | A | 10/2000 | Shimoda et al. | 347/101 |
| 6,132,502 | A | 10/2000 | Yatake | 106/31.86 |
| 6,140,391 | A | 10/2000 | Zou et al. | 523/160 |
| 6,156,072 | A | 12/2000 | Usui et al. | 8/115.6 |
| 6,161,929 | A | 12/2000 | Erdtmann et al. | 347/101 |
| 6,183,079 | B1 | 2/2001 | Meade et al. | 347/101 |
| 6,196,674 | B1 | 3/2001 | Takemoto | 347/103 |
| 6,200,667 | B1 * | 3/2001 | Haruta et al. | 428/32.32 |
| 6,206,516 | B1 | 3/2001 | Moriyama et al. | 347/101 |
| 6,262,796 | B1 | 7/2001 | Loopstra et al. | 355/53 |
| 6,267,518 | B1 | 7/2001 | Abe | 400/188 |
| 6,270,189 | B1 | 8/2001 | Miyashita et al. | 347/43 |
| 6,291,023 | B1 | 9/2001 | Nigam | 427/389.9 |
| 6,300,391 | B2 | 10/2001 | Parazak et al. | 523/160 |
| 6,322,620 | B1 | 11/2001 | Xiao | 106/31.92 |
| 6,326,419 | B1 | 12/2001 | Smith | 523/160 |
| 6,335,140 | B1 | 1/2002 | Miyazaki | 430/138 |
| 6,341,856 | B1 | 1/2002 | Thompson et al. | 347/100 |
| 6,416,923 | B2 | 7/2002 | Miyazaki | 430/200 |
| 6,450,633 | B1 | 9/2002 | Kronzer | 347/105 |
| 6,464,649 | B1 | 10/2002 | Duchon et al. | 600/583 |
| 6,500,880 | B1 | 12/2002 | Parazak | 523/160 |
| 6,513,924 | B1 | 2/2003 | Goldberg et al. | 347/106 |
| 6,536,894 | B1 | 3/2003 | Rasmussen et al. | 347/104 |
| 6,606,427 | B1 | 8/2003 | Graves et al. | 385/17 |
| 6,626,530 | B2 | 9/2003 | Snow et al. | 347/105 |
| 6,647,208 | B1 | 11/2003 | Kirby | 398/45 |
| 6,682,189 | B2 | 1/2004 | May et al. | 347/103 |
| 6,698,874 | B2 | 3/2004 | Katsuki | 347/95 |
| 6,755,518 | B2 | 6/2004 | Codos | 347/102 |
| 6,785,436 | B2 | 8/2004 | Ravikanth et al. | 385/16 |
| 6,840,992 | B2 | 1/2005 | Glaum et al. | 106/204.01 |
| 6,879,378 | B2 | 4/2005 | Morita et al. | 355/53 |
| 7,134,749 | B2 | 11/2006 | Ben-Zur et al. | 347/101 |
| 8,205,981 | B1 | 6/2012 | Marino et al. | 347/101 |
| 2002/0009662 | A1 | 1/2002 | Miyazaki | 430/138 |
| 2002/0022120 | A1 | 2/2002 | Katsuki et al. | 428/195 |
| 2002/0060728 | A1 | 5/2002 | Koizumi et al. | 347/101 |
| 2003/0142167 | A1 | 7/2003 | Nakamura et al. | 347/37 |
| 2003/0157304 | A1 | 8/2003 | Li et al. | 428/195 |
| 2003/0172840 | A1 | 9/2003 | Blank et al. | 106/31.27 |
| 2003/0197750 | A1 | 10/2003 | Iwatsuki et al. | 347/19 |
| 2003/0197772 | A1 | 10/2003 | Iwatsuki et al. | 347/104 |
| 2003/0205159 | A1 | 11/2003 | McNeil | 101/483 |
| 2004/0252173 | A1 * | 12/2004 | Ben-Zur et al. | 347/101 |
| 2005/0098054 | A1 | 5/2005 | Berndtsson et al. | 101/483 |
| 2005/0179706 | A1 | 8/2005 | Childers | 345/690 |
| 2005/0179708 | A1 | 8/2005 | Ben-Zur | 347/2 |
| 2007/0064077 | A1 * | 3/2007 | Konno | 347/102 |
| 2007/0103528 | A1 | 5/2007 | Pearl et al. | 347/101 |
| 2007/0103529 | A1 * | 5/2007 | Pearl et al. | 347/101 |
| 2007/0104899 | A1 | 5/2007 | Pearl et al. | 428/32.24 |
| 2007/0126831 | A1 * | 6/2007 | Suzuki et al. | 347/100 |
| 2008/0012884 | A1 | 1/2008 | Ben-Zur et al. | 347/2 |
| 2008/0092309 | A1 * | 4/2008 | Ellis | D06M 11/155 8/478 |
| 2009/0238978 | A1 | 9/2009 | Marino et al. | 427/261 |
| 2009/0294045 | A1 | 12/2009 | Marino et al. | 156/267 |

FOREIGN PATENT DOCUMENTS

| | | | |
|---|---|---|---|
| EP | 1281533 | 2/2003 | B41J 11/00 |
| GB | 422488 | 1/1935 | D06P 1/28 |

(Continued)

*Primary Examiner* — Alessandro Amari
*Assistant Examiner* — Kendrick Liu
(74) *Attorney, Agent, or Firm* — Nixon Peabody LLP

(57) ABSTRACT

Systems and methods are described for printing directly onto textiles including pre-treating a textile with a liquid solution to improve the quality of the printed image. The systems and methods prevent over saturation of the fibers of the textile by the ink thereby reducing undesirable mixing of the ink and blurring of the printed image.

12 Claims, No Drawings

(56) References Cited

FOREIGN PATENT DOCUMENTS

| | | | |
|---|---|---|---|
| JP | 61-075870 | 4/1986 | B41J 2/01 |
| JP | 63-031593 | 6/1988 | B41J 2/01 |
| JP | 5-293954 | 11/1993 | B41J 2/01 |
| JP | 8-232176 | 9/1996 | B41J 2/01 |
| JP | 9-039365 | 2/1997 | B41M 1/12 |
| JP | 10-278379 | 10/1998 | B41J 11/00 |
| JP | 11-138768 | 5/1999 | B41J 13/10 |
| JP | 2002-036644 | 2/2002 | B41J 11/50 |
| JP | 2002-332437 | 11/2002 | B41J 2/01 |
| JP | 2003-312069 | 11/2003 | B41J 11/06 |
| JP | 2004-532750 | 10/2004 | B41J 11/00 |
| JP | 2005-320663 | 11/2005 | B41J 2/01 |
| WO | 98/30749 | 7/1998 | B41M 5/52 |
| WO | 99/56948 | 11/1999 | B32B 3/00 |
| WO | 00/73570 | 12/2000 | D06Q 1/12 |
| WO | 01/17792 | 3/2001 | B41M 5/035 |
| WO | 01/32974 | 5/2001 | D06M 15/00 |
| WO | 01/49504 | 7/2001 | B41J 13/00 |
| WO | 02/066565 | 8/2002 | C09D 11/02 |
| WO | 02/078958 | 10/2002 | B41J 2/01 |
| WO | 2005/076730 | 8/2005 | B41J 11/00 |
| WO | 2005/115089 | 12/2005 | B41J 11/00 |
| WO | 2005/115761 | 12/2005 | B41K 11/00 |

* cited by examiner

SYSTEM AND METHOD FOR IMPROVED DIGITAL PRINTING ON TEXTILES

RELATED APPLICATIONS

The present application claims priority from U.S. Provisional Application Ser. No. 60/937,602 filed Jun. 27, 2007, which is incorporated herein by reference in its entirety for all purposes.

FIELD OF THE INVENTION

The present invention relates to systems and methods for digital printing on textiles. More particularly, the present invention relates to improved systems and methods for ink jet digital printing on all types and colors of textiles.

BACKGROUND OF THE INVENTION

Systems and methods for ink jet printing on textiles are well known. "Direct to garment" printing provides for the production of an image by placing ink drops directly onto the textile (garment) at distinct adjacent sites. This method of digital printing on textiles normally features an ink jet printer which applies ink on top of the textile. Herein a textile is defined as a flexible material comprised of a network of natural or artificial fibers often referred to as thread or yarn. Yarn is produced by spinning raw wool fibers, linen, cotton, or other material on a spinning wheel to produce long strands known as yarn. Textiles are formed by weaving, knitting, crocheting, knotting, or pressing fibers together. When applied, the ink penetrates the textile saturating the fibers, which is desirable for the image to be wash fast, meaning the ink does not rinse away when the textile is laundered. However, if the ink soaks down too deeply into the fibers the image vibrancy and resolution is adversely affected.

One way ink is delivered to the textile is through print heads in a manner similar to that employed by standard ink jet printers used for printing on paper products. Changes in textile thickness and print heads settings as well as environmental changes and different weaves from different mills impact the degree to which the ink beds down or saturates into the textile. In order to obtain the most vibrant and durable images on a textile, it is desirable to minimize the saturation of the fibers. In addition, current methods also produce colors that lack vibrancy, vividness and clarity because the ink when applied directly to the textile over saturates the textile. Embodiments of the present invention provide novel systems, methods and devices for digitally printing an image on a textile. Furthermore, the exemplar embodiments of the novel methods and systems herein restrict the inks ability to saturate the textile which increases the vibrancy, clarity and resolution of the image on the textile.

BRIEF SUMMARY OF THE INVENTION

In accordance with an embodiment of the present invention, systems and methods for printing directly onto textiles is provided including pre-treating a textile with a liquid solution, to improve an image quality printed on a textile.

In another embodiment, systems and methods for printing directly on textiles is provided including pre-treating a textile with a liquid solution, and digitally printing an image directly above the liquid solution.

In yet another embodiment, systems and methods for printing directly on textiles is provided including pre-treating a textile with a liquid solution, curing the pretreated textile, digitally printing a white layer of ink above the area pretreated with the liquid solution; curing the white ink layer and digitally printing an image directly above the white ink layer.

In one embodiment, the digital printing is performed by an inkjet printer.

In another embodiment the liquid solution is a water soluble solution.

In another embodiment the liquid solution is a solvent soluble solution.

Further according to the present invention there is a device for applying a liquid solution to a textile. The device includes a platen for holding a textile piece; at least one head above the textile piece for applying a liquid solution to the textile piece and a controller wherein the controller manipulates the at least one head above the textile piece.

In another embodiment, the device includes a curing unit.

Other and further features and advantages of the present invention will be apparent from the following descriptions of the various embodiments. It will be understood by one of ordinary skill in the art that the following embodiments are provided for illustrative and exemplary purposes only, and that numerous combinations of the elements of the various embodiments of the present invention are possible.

DETAILED DESCRIPTION OF PREFERRED EMBODIMENTS OF THE INVENTION

Various embodiments of the invention are described hereinafter. The embodiments are not intended as an exhaustive description of the invention or as a limitation on the scope of the invention. In addition, an aspect described in conjunction with a particular embodiment of the invention is not necessarily limited to that embodiment and can be practiced in any other embodiment of the invention.

The present invention relates to improved systems and methods for direct printing of an image on a textile. In particular, the invention relates to direct to garment/textile image printing using digital methods. The invention is equally applicable to printing on light or white textiles as well as colored or dark textiles. However, when printing on a white textile it may be preferable to not apply a white layer of ink as described below.

General printing on a textile is known to one of skill in the art, however, printing on a textile and preventing over saturation is a problem that has not been solved by the industry. Over saturation is what occurs when too great a volume of ink is put onto a garment and the ink's hydrostatic attraction for itself overcomes its attraction for the garment causing the ink to draw together into flows of ink in which individual ink droplets become mixed with each other and displaced from their original location resulting in a miscolored blurry image. In a wet on wet printing application the ink also tends to coagulate into areas of high ink density and low ink density resulting in smooth solid colors being rendered as spotty. Embodiments of the present invention, improve upon general printing on a textile by providing systems and methods that assist in avoiding over saturation of the textile. In one process for printing an image on a textile the process begins by applying a liquid solution as disclosed herein. In this embodiment, the liquid solution selected is one of a chemical composition such that a non-absorbent barrier is formed on the textile. Examples of liquid solutions include liquid born polymers and waxes.

Liquid born polymers are chemicals formed by the union of many monomers (a molecule of low molecular weight). Polymers are used with other chemical coagulants to aid in binding small suspended particles to larger chemical flocs. The exemplar liquid solutions are provided for illustrative purposes only and are not intended to limit the scope of the embodiments of the present invention. One skilled in the art will recognize that other liquid solutions that result in a non-absorbent surface are contemplated within the scope of the present invention. The liquid solution is applied to the area of the textile on which the image will ultimately be printed. The liquid solution may be applied in a variety of ways including but not limited to a spray, roll, or jet. After the liquid solution is applied it may need to be cured or dried to prevent its dissolution or mixing with any subsequent solutions or inks that are applied to the textile. The application of the liquid solution is then followed by the printing of an image on the textile. In this embodiment, the application of the liquid solution prior to printing prevents the ink that creates the image from penetrating too deeply into the textile fibers.

In an alternative embodiment of a method for printing an image on a textile, the method begins by applying a liquid solution, such as those disclosed herein, to the area of the textile on which the image will ultimately be printed. The liquid solution may be applied in a variety of ways including but not limited to a spray, roll, or jet. In this embodiment, the liquid solution is not cured or dried but rather is left in its original liquid phase. The application of the liquid solution is then followed by printing an image on the textile. The liquid solution thus reacts, including the possibility of a chemical reaction, with the ink that is applied to create the image. The reaction between the liquid solution and the ink causes the ink to change in density, thicken, solidify, coagulate or gel such that the saturation of the ink into the fibers of the textile is limited. Limited saturation is the ink being unable to sink into the weave formed by the threads of the garment but still being able to intermingle with the surface fibers of the threads to allow for proper post-cure adhesion. The reaction is a polymerization reaction in which a catalyst reagent causes a second reagent to form long chain polymers from base monomers or smaller polymers which can be jetted through an inkjet head. The long chain polymers are what is responsible for the thickening and/or solidification.

The liquid solution identified above may be a water soluble solution such as an aloe or a white glue or honey in varying concentrations when using water based inks. Alternatively, when using solvent based inks, it will be a solvent soluble solution such as stabilized alcohol. Generally, the liquid solution must have the attributes such that it does not change the chemistry of the ink or block the ink from adhering to the textile. If the liquid solution does change the chemistry of the ink as described above, it causes the ink to become firmer. However, care must be taken to ensure the ink does not become too thick or else the resolution of image printing may be compromised. Preferably, the liquid solution is of chemistry such that it aids in bonding down the pills of the shirt to enhance print quality.

As discussed above if the liquid solution is cured after application such curing may be accomplished in any conventional manner, such as UV curing lamp, infrared, hot air, a combination of pressure and heat, or baking depending on the ink and/or liquid solution type and application. The time and pressure for curing the liquid solution may vary with the quantity and chemistry of the liquid solution applied to the textile. For example, if a low concentration solution is used, the solution must be cured for a longer period of time and will allow for a more even distribution of the active chemical whereas if a high concentration solution is used, the solution is cured for a shorter period of time, but will result in a less even distribution of the active chemical unless great care is taken in the application.

If a water soluble liquid solution is applied, the area of the textile covered by the liquid solution may exceed the boundaries of the image area as the liquid solution may subsequently be washed away. Alternatively, if a solvent based liquid solution is used, preferably the liquid solution is placed exactly on the designed image area, in order to cover it completely, but not to exceed it. However if the solvent based liquid is transparent it may exceed the print area. In either instance, the liquid solution should be applied in a dense manner to assure adequate coverage.

If a white ink is placed prior to printing the image the white ink is placed on top of the liquid solution exactly on the designed image area, in order to cover it completely, but not to exceed it. Printing resolution of the white ink can be lower than the resolution of the process colors, and the drop size can be larger, to reduce printing time.

The liquid solution may be applied manually using a spray, roll, or jet or a device may be employed to apply the solution, or any other means known to one of skill in the art. Regardless of the method, manually or by a device, the textile is placed on a platen before the process begins. The platen may be a stationary platen if the ink print heads and solution applicator are in motion, alternatively the platen may be a moving platen wherein the textile will move and the ink print heads and liquid solution means are stationary. Preferably, a controller controls the process of applying the liquid solution, and also controls the cure process after the application of the liquid solution if necessary. The controller may be the same controller that controls the application of the ink and curing of the ink for the image, alternatively, a second controller may be employed. The image is applied using an ink jet printer and conventional means.

As noted previously the forgoing descriptions of the specific embodiments are presented for purposes of illustration and description. They are not intended to be exhaustive or to limit the invention to the precise forms disclosed and obviously many modifications and variations are possible in view of the above teachings. The embodiments were chosen and described in order to explain the principles of the invention and its practical applications, to thereby enable those skilled in the art to best utilize the invention and various embodiments thereof as suited to the particular use contemplated. It is intended that the scope of the invention be defined by the following claims and their equivalents.

The invention claimed is:

1. A method for direct to garment printing on a textile, comprising:

pretreating an area of the textile with a water-soluble liquid solution;

curing the water-soluble liquid solution to form a dried pretreatment on the textile;

printing a white ink onto a portion of the area pretreated with the water-soluble liquid solution, the portion being a designed image area, the dried pretreatment reacting with the white ink in a chemical reaction to form a substance that has a thicker consistency than either the liquid solution or the ink, the substance permitting the white ink to intermingle with surface fibers of threads of the textile while limiting the saturation of the white ink into the textile;

digitally printing with colored ink within the designed image area on which the white ink has been printed; and curing the designed image area such that the pretreatment remaining outside the designed image area can be washed away after the curing.

2. The method of claim 1, wherein the digital printing is performed by an inkjet printer.

3. The method of claim 1, wherein the curing the water-soluble liquid solution includes applying heat and pressure.

4. A method for direct to garment printing, comprising:

applying a water-soluble liquid solution to an area of a textile;

curing the water-soluble liquid solution to form a dried pretreatment on the textile;

applying white ink to only a part of the area of the textile, the part being a designed image area, wherein the dried pretreatment on the textile and the white ink react in a chemical reaction to form a substance that has a thicker consistency than either of the liquid solution or the white ink, the substance causing the white ink to intermingle with surface fibers of threads of the textile; and curing the substance within the designed image area on the textile; and after the curing, digitally printing with colored ink on the designed image area on which the white ink was previously printed, the pretreatment remaining outside the designed image area can be subsequently washed from the textile.

5. The method of claim 4, wherein the pretreatment and the ink react in a polymerization reaction.

6. The method of claim 5, wherein the polymerization reaction comprises a catalyst reagent causing a second reagent to form long chain polymers from one of base monomers or small polymers, wherein either of the base monomers or the small polymers can be jetted through an inkjet head.

7. The method of claim 4, wherein the substance is firmer than either of the liquid solution or the ink.

8. The method of claim 4, wherein the substance is a semisolid.

9. The method of claim 4, wherein the pretreatment aids in bonding down fibers of the textile.

10. The method of claim 4, wherein the applying steps are performed by inkjet heads.

11. The method of claim 4, wherein the applying the water-soluble liquid solution is accomplished through a spraying process.

12. The method of claim 4, wherein the curing the water-soluble liquid solution includes applying heat and pressure.

* * * * *